US007075489B2

(12) United States Patent
Takaoka et al.

(10) Patent No.: US 7,075,489 B2
(45) Date of Patent: Jul. 11, 2006

(54) METHOD FOR INSTALLING ANTENNA, ANTENNA INSTALLATION STRUCTURE, AND MONITOR

(75) Inventors: Akira Takaoka, Okazaki (JP); Akihiko Hayashi, Ogaki (JP)

(73) Assignees: Nippon Soken, Inc., Nishio (JP); DENSO Corporation, Kariya (JP)

( * ) Notice: Subject to any disclaimer, the term of this patent is extended or adjusted under 35 U.S.C. 154(b) by 358 days.

(21) Appl. No.: 10/679,641

(22) Filed: Oct. 6, 2003

(65) Prior Publication Data

US 2004/0066342 A1 Apr. 8, 2004

(30) Foreign Application Priority Data

Oct. 7, 2002 (JP) ..... 2002-293745

(51) Int. Cl.
*H01Q 1/32* (2006.01)

(52) U.S. Cl. ..... 343/713; 343/767

(58) Field of Classification Search ..... 343/700 MS, 343/702, 713, 711, 767, 769
See application file for complete search history.

(56) References Cited

U.S. PATENT DOCUMENTS 5,355,144 A * 10/1994 Walton et al. ..... 343/713
6,249,242 B1 * 6/2001 Sekine et al. ..... 342/70
2004/0046701 A1 * 3/2004 Huber et al. ..... 343/702

* cited by examiner

*Primary Examiner*—Tuyet Vo
*Assistant Examiner*—Jimmy Vu
(74) *Attorney, Agent, or Firm*—Harness, Dickey & Pierce, PLC

(57) ABSTRACT

A vehicular antenna is mounted on a circuit board in a monitor. The circuit board has a conductor substrate that is used as a ground for the antenna, and it has a frame shape that has a rectangular inner edge. The circuit board has an electrical contact for connecting the antenna. The electrical contact is placed at λ/4 away from an axisymmetrical line (center line) with respect to the inner edge. As a result, a gain of the vehicular antenna is not reduced in a front direction even when the vehicular antenna uses the frame shape conductor as the ground.

7 Claims, 11 Drawing Sheets

METHOD FOR INSTALLING ANTENNA, ANTENNA INSTALLATION STRUCTURE, AND MONITOR

CROSS REFERENCE TO RELATED APPLICATIONS

This application is based on Japanese Patent Application No. 2002-293745 filed on Oct. 7, 2002, the contents of which are incorporated herein by reference.

BACKGROUND OF THE INVENTION

1. Field of the Invention

The present invention relates to a method for installing an antenna, an antenna installation structure, and a monitor, and more particularly, to a method of installing an antenna on an electrical monitor for a wireless network system inside a vehicle.

2. Description of Related Art

Recently, wireless communication terminals, such as mobile phones, are increasingly used. In particular, technologies for a bluetooth or a wireless local area network (LAN) that use microwave frequencies are likely to become widespread in the future. Research and development on an in-vehicle network based on the technologies that use the wireless communication terminals are also currently being conducted.

The in-vehicle network performs communication between a handheld device and an in-vehicle information technology (IT) device to provide better driver convenience. For example, the handheld device is a mobile phone, a personal digital assistant (PDA), and a mobile computer, and it is held by the driver. The in-vehicle IT device is a vehicular navigation device, a dedicated short-range communication (DSRC) device, and a telematics device. As a result, the in-vehicle IT devices tend to gather around a cockpit, such as an instrument panel close to the driver. In such a situation, a radio terminal and an antenna of the in-vehicle network may be installed within an electrical monitor in the instrument panel. The electrical monitor displays various kinds of information for the vehicular navigation device, an audio device, an air temperature probe, and a detector for detecting a driving status. The monitor also has a touch panel to receive a command from the driver.

SUMMARY OF THE INVENTION

An object of the present invention is to provide a method for installing an antenna, an antenna installation structure, and a monitor to have a high radiative gain with respect to a vehicular antenna for an in-vehicle network when the vehicular antenna is installed within an electrical monitor and particularly for when the vehicular antenna is disposed on a circuit board of the electrical monitor.

According to one aspect of the present invention, an antenna uses a conductor as a ground. The conductor has a frame shape having an inner edge that has a rectangular shape. An electrical contact that is used for connecting the antenna is provided on the conductor away from an axisymmetrical line defined with respect to the inner edge. As a result, interference by a radiation from the conductor due to a secondary radiation is reduced. Therefore, a reduction of a gain due to a secondary radiation from the conductor is prevented even when the antenna uses the frame shape conductor as the ground.

According to another aspect of the present invention, an antenna installation structure has a conductor and an antenna. The antenna uses the conductor as a ground. The conductor has a frame shape having an inner edge. IT has an electrical contact for connecting the antenna. The electrical contact is disposed away from an axisymmetrical line defined with respect to the inner edge. Therefore, the reduction of the gain due to the secondary radiation from the conductor is prevented even when the antenna uses the frame shape conductor as the ground.

According to another aspect of the present invention, a monitor has a display, a panel, a circuit board, and an antenna. The circuit board has a conductive plate. The antenna uses the conductive plate as a ground. The circuit board has an electrical contact for connecting the antenna. The electrical contact is disposed away from an axisymmetrical line defined with respect to the inner edge. Therefore, the reduction of the gain due to the secondary radiation from the conductor is prevented even when the antenna uses the frame shape conductor as the ground.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

Figure 1:
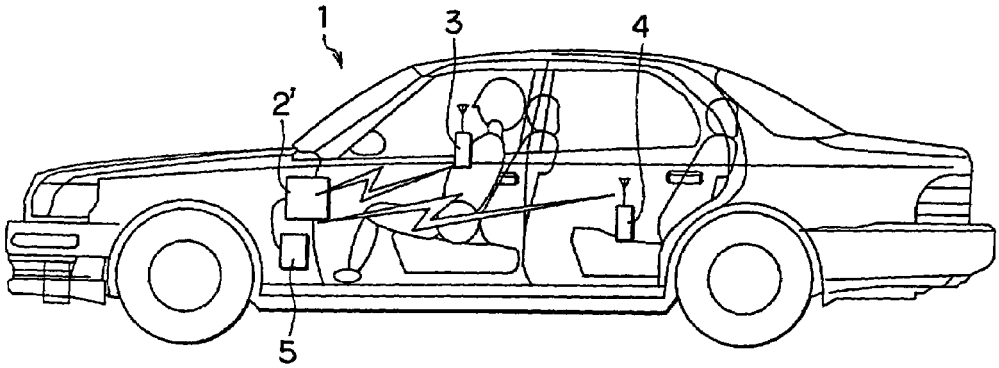
FIG. 1 is a partially sectional side view showing a in-vehicle network according to an embodiment of the present invention.

The preferred embodiments of the present invention will be explained with reference to the accompanying drawings. In the drawing, the same numerals are used for the same components and devices.

[Comparative Example]

Figure 17:
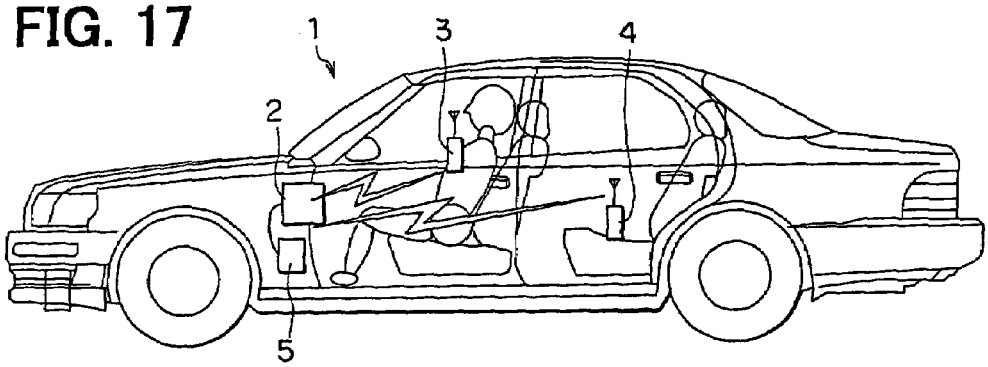
FIG. 17 is a partially sectional side view showing a in-vehicle network according to the comparative example.

Initially, a comparative example will be explained. An in-vehicle network in a vehicle 1 is shown in FIG. 17 according to the comparative example. In the in-vehicle network, an electrical monitor 2, a mobile phone 3, and a PDA communicate with each other over the air in accordance with a standard of a bluetooth. The electrical monitor 2 communicates with a speaker 5 via a cable.

Figure 18:
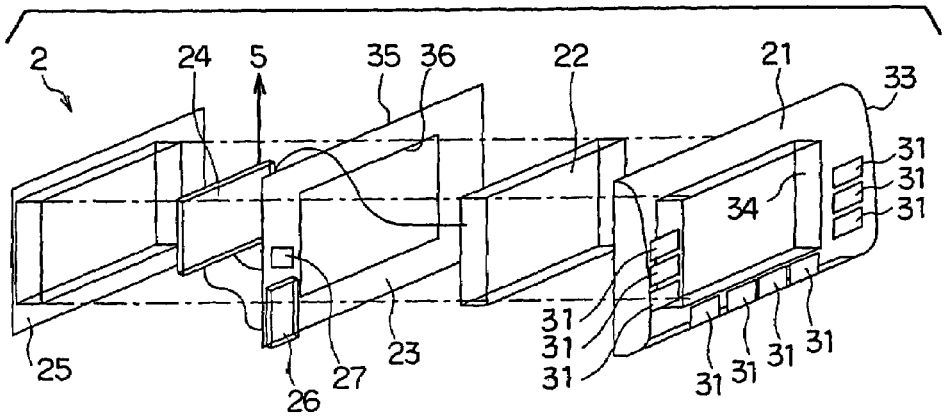
FIG. 18 is a disassemble perspective view showing a monitor.

FIG. 18 shows a disassemble perspective view of the electrical monitor 2. The monitor 2 includes a front panel 21, a liquid crystal display 22, a circuit board 23, a control circuit 24, a rear panel 25, a wireless communication circuit 26, and a vehicular antenna 27. The monitor 2 is assembled as shown in FIG. 18. A right side in FIG. 18 shows a front direction of the monitor 2.

The front panel 21 has operational buttons 31 for receiving inputs from a driver. The front panel 21 has a rectangular shape that has an outer edge 33 and an inner edge 34 when viewed from the front direction so that an image of the display 22 is visible to the driver. That is, it is formed into a rectangular shape that has a rectangular hole. In other words, it has a frame shape that has the inner edge 33, like a picture frame.

The display 22 has a rectangular shape so that the display 22 is fitted into the inner edge 34 of the front panel 21. It faces to the front direction of the electrical monitor 2.

The circuit board 23 has a frame shape similar to that of the front panel 21. The circuit board 23 has a rectangular frame shape that has an outer edge 35 and an inner edge 36 that has a rectangular shape. The circuit board 23 is fixed to the front panel 21 in a condition that the display 22 is inserted in the circuit board 23. It has multi-layer substrates. In a front substrate, it has a circuit pattern that detects an operation of the operational buttons 31 of the front panel 21. It also sends an electronic signal to the control circuit 24 via a wire based on the detection of the operation. In a middle substrate of the circuit board 23, an electrical conductor is provided all over the middle substrate. Accordingly, the circuit board 23 is a kind of conductive plate.

The control circuit 24 is fixed to the rear panel 25. The control circuit 24 receives electrical signals based on the inputs from the driver via the circuit board 23, and communicates with the mobile phone 3 and the PDA 4. It also controls the display 22 to show information based on the electrical signals and the communication if necessary.

The rear panel 25 is fixed to the front panel 21, so that backsides of the vehicular antenna 27, the wireless communication circuit 26, the control circuit 24, the circuit board 23, and the display 22 are protected from the external environment.

The wireless communication circuit 26 and the vehicular antenna 27 are mounted on the circuit board 23. The wireless communication circuit 26 and the vehicular antenna 27 are placed at predetermined positions so that radio waves received from and/or transmitted to the front direction of electrical monitor 2, which is one of directions from the circuit board 23, are not prevented from communicating with an external device.

Figure 19:
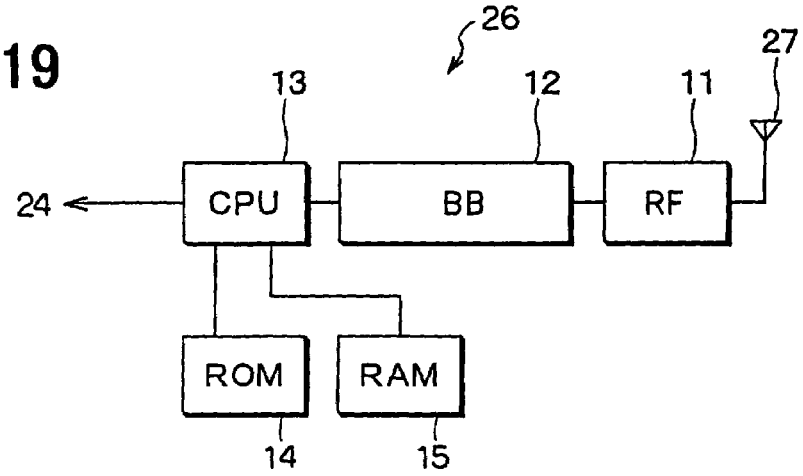
FIG. 19 is a block diagram showing a wireless communication circuit.

As shown in FIG. 19, the wireless communication circuit 26 has a radio frequency (RF) part 11, a base band (BB) part 12, a central processing unit (CPU) 13, a read only memory (ROM) 14, and a random access memory (RAM) 15. The RF part 11 is connected to the vehicular antenna 27, and it receives a radio wave including a signal via the vehicular antenna 27. The RF part 11 performs an analog process to the signal received from the vehicular antenna 27. The analog process includes amplification, a filtering, a frequency conversion, and an analog-to-digital conversion. The BB part 12 performs digital processes, such as a demodulation. The CPU 13 operates based on a program stored in the ROM 14, and it writes data to the RAM 15 and reads data from the RAM 15 if necessary, so that it processes a communication control to the received data digitized by the BB part 12. The CPU 13 also communicates data and a control signal with the circuit board 24 via a conductive cable if necessary. In the wireless communication circuit 26, the BB part 12 performs digital processes, such as a modulation, to data inputted from the CPU 13 for wireless communication. The RF part 11 performs an analog process to the data, and it sends the analog-processed data to the vehicular antenna 27. The analog process includes a digital-to-analog conversion, amplification, a frequency conversion, and a filtering.

The vehicular antenna 27 is a planar antenna, and it uses the electrical conductor of the circuit board 23 as a ground plate. The vehicular antenna 27 is electrically connected to the electrical conductor of the circuit board 23. Hereinafter, the electrical connection between the vehicular antenna 27 and the electrical conductor of the circuit board 23 will be referred to as the electrical connection between the vehicular antenna 27 and the circuit board 23.

Figure 20:
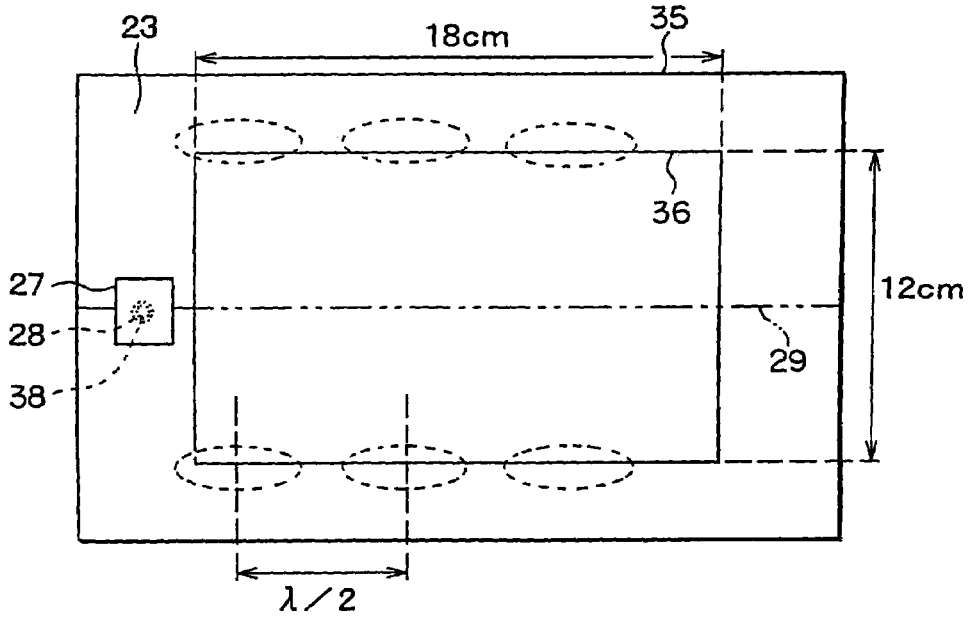
FIG. 20 shows a front view showing the circuit board and the vehicular antenna along with electrical current distributions on the circuit board according to the comparative example.

FIG. 20 shows the circuit board 23 and the vehicular antenna 27, which is mounted on the circuit board 23, when viewed from the front direction of the electrical monitor 2, i.e., from a visual surface side of the display 22. As shown in FIG. 20, the vehicular antenna 27 is disposed on the circuit board 23. More particularly, the vehicular antenna 27 is disposed on an imaginary axisymmetrical line that divides the circuit board 23 into symmetrical portions. The axisymmetrical line is also an axisymmetrical line with respect to the inner edge 36 of the circuit board 23. The circuit board 23 has two axisymmetrical lines. One is shown by a two-dot chain line (hereinafter referred to as a centerline 29) in FIG. 20. The centerline 29 is the axisymmetrical line, which divides a surface of the circuit board 23 into an above area and a below area, in a horizontal direction of FIG. 20. The other is the axisymmetrical line (not shown), which divides the surface of the circuit board 23 into a right area and a left area, in a vertical direction.

The vehicular antenna 27 is electrically and directly connected to the circuit board 23 at the mounted place. In detail, a ground terminal 28 provided on a back side of the vehicular antenna 27 is connected to an electrical contact 38 provided on the surface of the circuit board 23. The electrical contact 38 is electrically conducted to the middle substrate of the circuit board 23. That is, the vehicular antenna 27 is placed on the electrical point.

According to the electrical connection of the vehicular antenna 27 and the circuit board 23, the vehicular antenna 27 can radiate the radio wave so that the circuit board 23 is used as a ground. As a result, an output performance of the vehicular antenna 27 is improved because an area of the ground is increased. However, in such a situation, when the vehicular antenna 27 radiates the radio wave, an electrical current is passed through the circuit board 23. As a result, a secondary radiation from the circuit board 23 occurs. The secondary radiation influences the radio wave radiated directly from the vehicular antenna 27. As will be discussed more fully below, this may negatively influence the radiation from the vehicular antenna 27.

Figure 21:
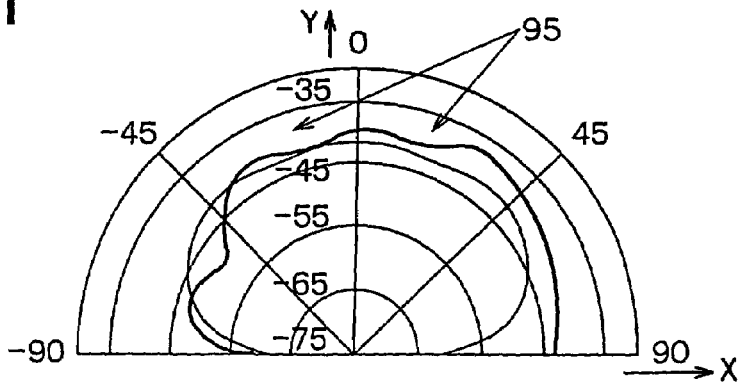
FIG. 21 shows radiation patterns according to the comparative example.

FIG. 21 shows radiation patterns in every direction from the vehicular antenna 27 and the circuit board 23 in the in-vehicle network when the vehicular antenna 27 radiates the radio wave at the 2.4-gigahertz (GHz) frequency band, which is used for the bluetooth. The radiation patterns were measured by the inventors. FIG. 21 is a graph of the radiation pattern plotted by a bold line that shows a gain of the antenna in every direction. The gain is a combination of a vertical component and a horizontal component. A direction indicated by an angle of 0 degree is the front direction of the display 22. A direction indicated by angles of 90 degrees and −90 degrees is a parallel direction with the surface of the display 22. As shown in FIG. 21, dips 95 are formed into the bold line in front directions. This shows a reduction of the gain in the corresponding direction. If the gain is reduced in the front direction, it may prevent wireless communication between the in-vehicle network and the handheld device, such as the mobile phone 3, the PDA 4.

It is known that the reduction of the gain does not occur in the front direction if an antenna has a normal ground plate that is not a frame shape like the circuit board 23 but a plane plate. Therefore, the frame shape of the circuit board 23 having the inner edge 36 is considered to cause the reduction of the gain. In fact, distributions of electric current in the circuit board 23 are analyzed with numerical calculation (moment method). As a result, strong high frequency electrical currents pass along the inner edge 36 of the circuit board 23, which is the conductor, within ellipses shown in FIG. 20. It is also known that the high frequency electrical currents cause electromagnetic radiation as a dipole antenna. Therefore, it is considered that the high frequency electrical currents influence radiation from the vehicular antenna 27.

Accordingly, the present invention has the object to have a high radiative gain of the antenna 27. In other words, the present invention has the object to prevent the reduction of the gain of the radiation from the antenna 27 in the directions away from the circuit board 23 and the antenna 27 when the antenna 27 uses the frame shape conductor having the inner edge as the ground surface.

[Preferred Embodiment]

Referring again to FIG. 1, a preferred embodiment of the present invention will be explained. An in-vehicle network is shown in FIG. 1. The in-vehicle network has a different electrical monitor 2', instead of the electrical monitor 2 of the in-vehicle network in the comparative example shown in FIG. 17. The in-vehicle networks of the embodiment and the comparative example are identical with the exception of the electrical monitors 2, 2'. The difference between the electrical monitors 2', 2 will be explained.

Figure 2:
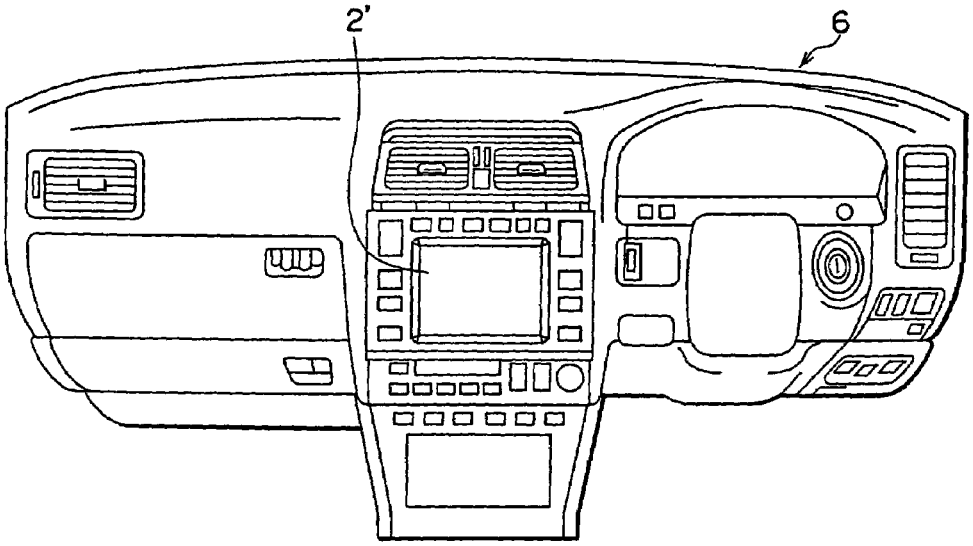
FIG. 2 is a front view showing an instrument panel according to the embodiment.

An arrangement of the electrical monitor 2' in the vehicle is shown in FIG. 2. FIG. 2 shows a front view of an instrument panel 6. The electrical monitor 2' is mounted in a center of the instrument panel 6.

Figure 3:
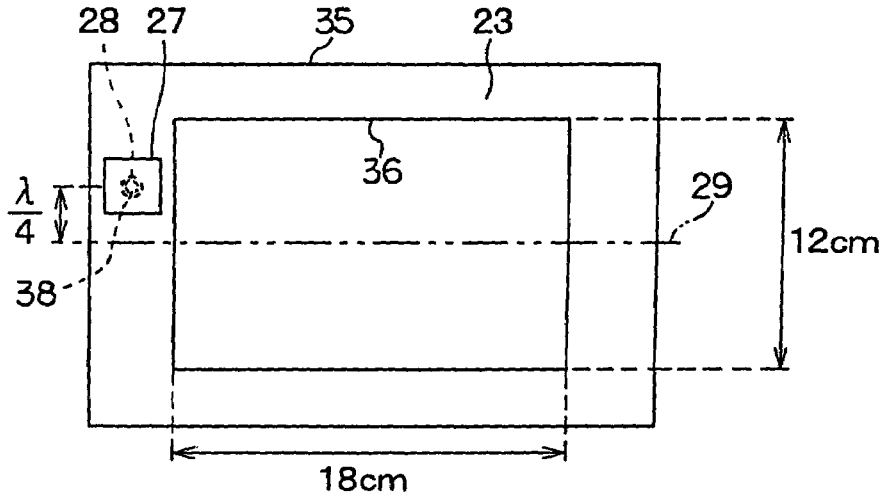
FIG. 3 is a front view showing a circuit board and a vehicular antenna according to the embodiment.

The electrical monitor 2' has the same components as the electrical monitor 2 shown in FIG. 18. However, a position of the electrical contact 38 of the embodiment is different from the comparative example shown in FIG. 18. FIG. 3 shows the circuit board 23 and the vehicular antenna 27 mounted on the circuit board 23 when viewed from the front direction of the electrical monitor 2', i.e., from the visual surface of the display 22. The front direction is a direction away from the circuit board 23. In FIG. 3, the symbol "λ" is a wavelength of the radio wave that is transmitted and received by the wireless communication circuit 26 via vehicular antenna 27. In the embodiment, the wavelength λ is a size of radio waves of 2.4 GHz, that is, it is 12 centimeters (cm). In FIG. 3, the two-dot chain line is the centerline 29 of the circuit board 23. That is, the line is the axisymmetrical line, which divides the circuit board 23 into the above area and the below area.

The vehicular antenna 27 is placed on the circuit board 23 at a predetermined position λ/4 (3 cm) away from the centerline 29. The centerline 29 is also the axisymmetrical line, which divides the circuit board 23 into the above area and the below area. The vehicular antenna 27 is electrically connected to the circuit board 23 at the position. In detail, the ground terminal 28 on the back side of the vehicular antenna 27 is connected to the electrical contact 38, which is connected to the middle substrate, provided on the surface of the circuit board 23. Accordingly, the electrical contact 38 for connecting the vehicular antenna 27 is one fourth of the wavelength λ away from the centerline 29.

Figure 4:
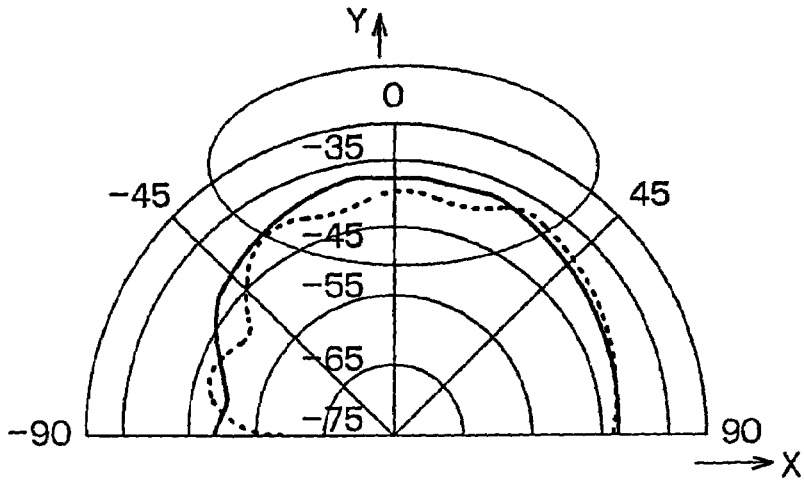
FIG. 4 is a graph showing radiation patterns of radio waves radiated from the vehicular antenna and the circuit board according to the embodiment and a comparative example.

FIG. 4 shows a graph that is a measurement result of the radiation patterns from the vehicular antenna 27 and the circuit board 23 in every direction when the electrical contact 38 between the vehicular antenna 27 and the circuit board 23 is provided at the predetermined position and the vehicular antenna 27 radiates radio waves at the 2.4 GHz frequency band. FIG. 4 is a graph plotted in decibel (dB) unit with respect to the gain of the radio wave in every direction. The gain is the combination of the vertical component and the horizontal component. The direction indicated by the angle of 0 degree is the front direction of the display 22. The direction indicated by the angles of 90 degrees and −90 degrees is a parallel direction with the surface of the display 22. The solid line shows the measurement result of the electrical monitor 2' of the embodiment, and a dotted line shows the measurement result of the electrical monitor 2 of the comparative example shown in FIG. 21 in the same condition.

In the electrical monitor 2' of the embodiment, the dips 95 are not formed within an area shown by an ellipse in FIG. 4, i.e., in the front direction of the electrical monitor 2', although the dips 95 are formed when the vehicular antenna 27 of the electrical monitor 2 radiates the radio wave. As a result, the reduction of the gain of the radiation in the front direction is prevented.

As described above, the electrical contact 38 is one fourth of the wavelength away from the centerline 29. Accordingly, the reduction of the gain in the front direction due to the secondary radiation radiated from the circuit board 23 is prevented even when the antenna 27 uses the frame shape conductor having the inner edge 36 as the ground.

Then, it is considered a theory how to improve the gain of the radiation in the front direction when the position of the electrical contact 38 between the circuit board 23 and the vehicular antenna 27 is λ/4 away from the centerline 29.

Figure 5:
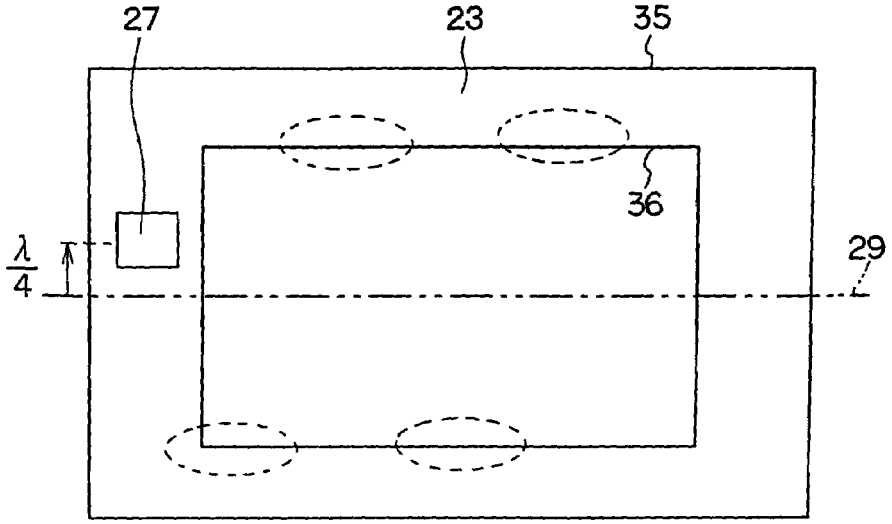
FIG. 5 shows a front view showing the circuit board and the vehicular antenna along with electrical current distributions on the circuit board according to the embodiment.

With respect to the circuit board 23 and the vehicular antenna 27 shown in FIG. 3, FIG. 5 shows an analyzed result of the distributions of the electrical current in the circuit board 23 with the numerical calculation (moment method) on the condition that the antenna 27 radiates the radio wave. In FIG. 5, high frequency electrical currents that are stronger than the peripheral portion pass along the inner edge 36 of the circuit board 23 within ellipses. In detail, the strong high frequency electrical currents are approximately one-fifth of the maximum electrical current that is measured immediately below the vehicular antenna 27.

In comparison with FIG. 20 that shows analyzed result of the comparative example when the numerical calculation is performed in the same condition, the positions through which the strong high frequency electrical currents pass in the embodiment are different from the comparative example shown in FIG. 20. The difference will be explained in detail according to FIGS. 6, 7.

Figure 6:
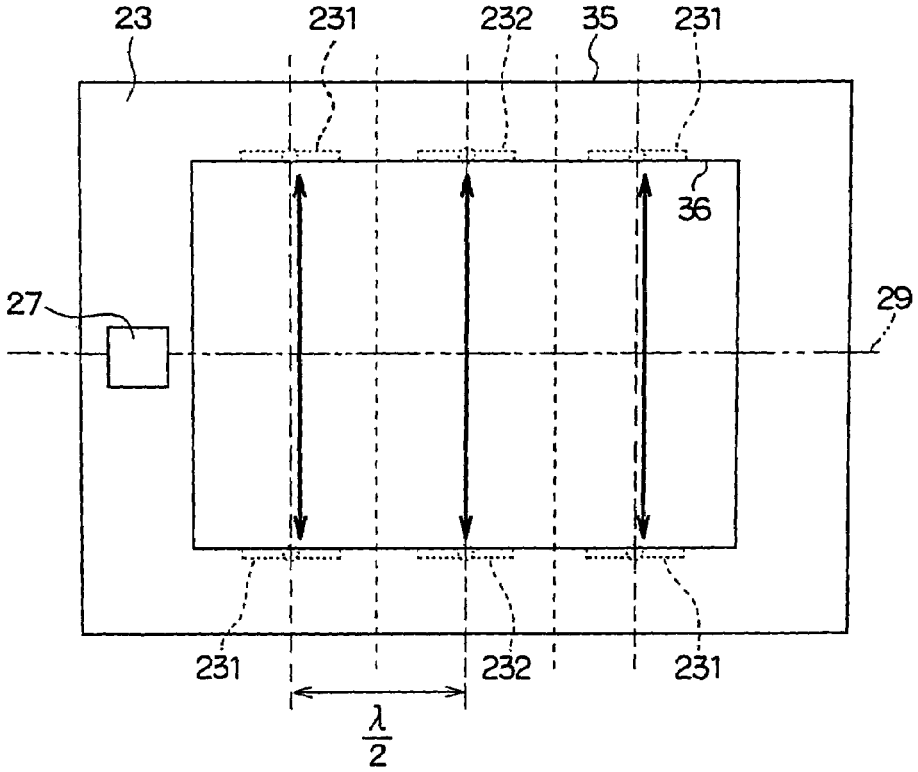
FIG. 6 shows an arrangement of a high frequency electrical current on a circuit board according to the comparative example.

FIG. 6 shows an arrangement of the high frequency electrical current that occurs in the inner edge 36 of the circuit board 23 in the comparative example shown in FIG. 20. The dotted lines along the inner edge 36 of the circuit board 23 in FIG. 6 show areas in which the strong high frequency electrical current flows. In-phase currents 231 indicate that the electrical currents flow in the same direction with each other. Reverse-phase currents 232 indicate that the electrical currents flow in the opposite direction compared with the in-phase currents 231. As shown in FIG. 6, pairs of the strong high frequency electrical currents indicated by arrows are presented so that pairs of the in-phase currents 231 and a pair of the reverse-phase currents 232 are opposed to each other in the vertical direction. The pairs are λ/2 away from each other in the horizontal direction.

Figure 7:
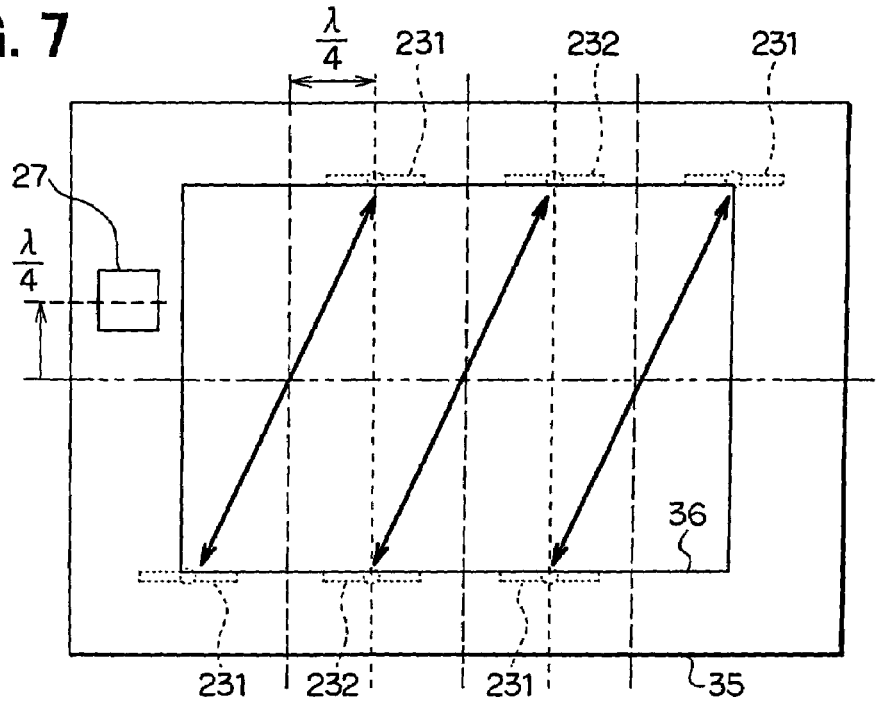
FIG. 7 shows an arrangement of a high frequency electrical current on the circuit board according to the embodiment.

FIG. 7 shows the arrangement of the high frequency electrical current that occurs in the inner edge 36 of the circuit board 23 in the embodiment shown in FIG. 5 in the same manner as FIG. 6. In FIG. 7, pairs of the in-phase currents 231 are not presented so that the pairs of the in-phase currents 231 are opposed to each other in the vertical direction. The pairs are shifted with each other by λ/2 in the horizontal direction. It is known that the portion in which the strong high frequency electrical current flows is equated with the dipole antenna that radiates the radio wave. Hereinafter, the portion in which the strong high frequency electrical current flows is referred to as the dipole antenna.

An influence of the difference between the arrangements on the radiation from the vehicular antenna 27 will be explained qualitatively. The difference between the arrangements of the strong high frequency electrical currents formed in the inner edges 36 of the circuit boards 23 occurs based on the difference between the positions of the electrical contacts 38 in the circuit board 23.

Figure 8A:
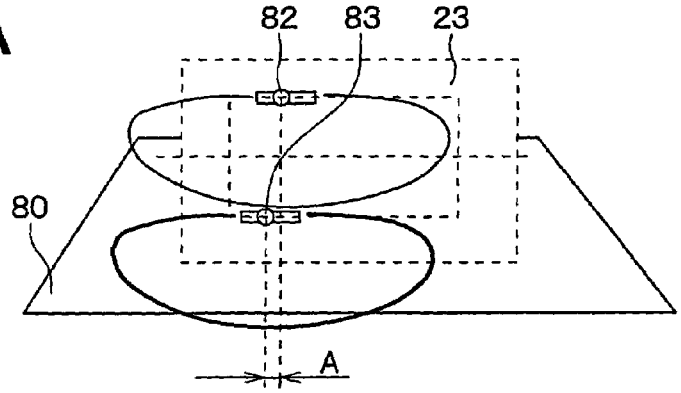
FIG. 8A is a schematic view showing radiation patterns of radio waves radiated from a pair of in-phase dipole antennas formed on the circuit board according to the comparative example.
Figure 8B:
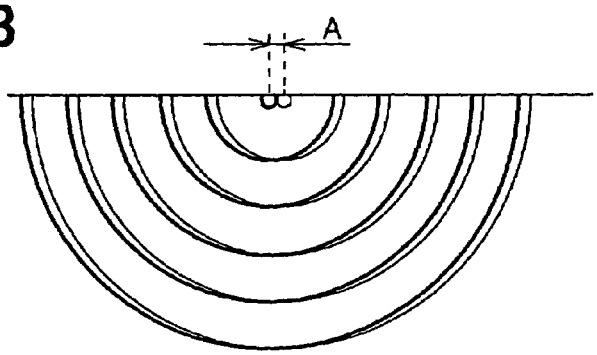
FIG. 8B shows wave fronts radiated from the pair of the in-phase dipole antennas according to the comparative example.

FIG. 8A is a schematic view showing the radiation patterns of the radio waves from the pair of the positions through which the in-phase high frequency electrical currents pass in a plane 80 shown in FIG. 6. The plane 80 is perpendicular to the circuit board 23 so that the plane 80 includes the centerline 29 of the circuit board 23. Solid lines extending from the dipole antennas 82, 83 present directivity of the radiation in the plane 80. FIG. 8B shows wave fronts radiated from the dipole antennas 82, 83 in the plane 80. The wave fronts from the dipole antennas 82, 83 approximately correspond to each other, and strengthen each other.

Figure 9A:
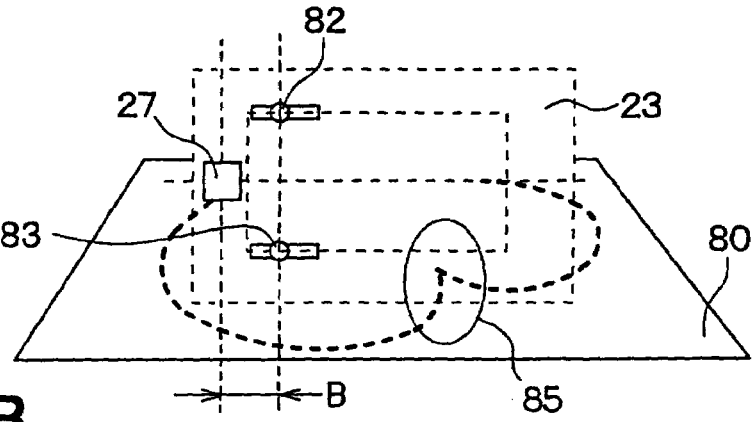
FIG. 9A is a schematic view showing radiation patterns of radio waves radiated from the pair of dipole antennas and a vehicular antenna according to the comparative example.
Figure 9B:
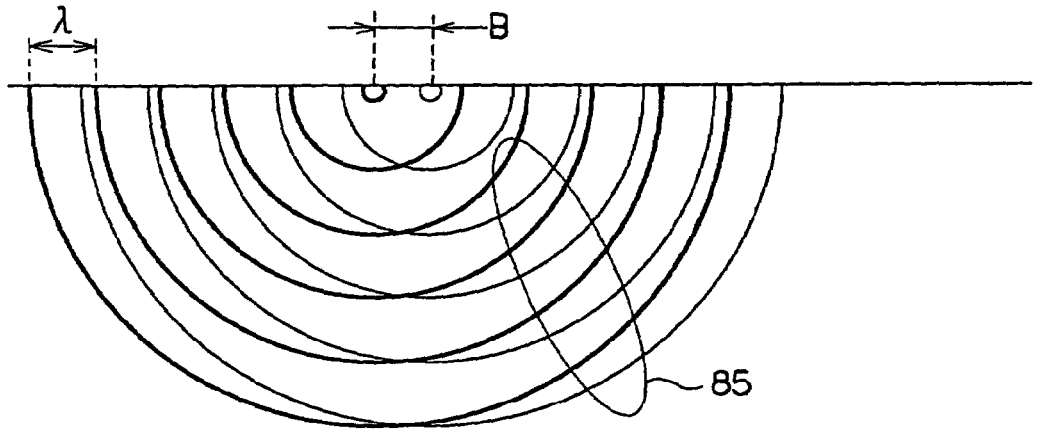
FIG. 9B shows wave fronts radiated from the pair of the dipole antennas and the vehicular antenna according to the comparative example.

FIG. 9A is a schematic view showing the radiation patterns of the radio waves from the dipole antennas 82, 83 and the vehicular antenna 27 in the plane 80. FIG. 9B shows wave fronts radiated from the vehicular antenna 27 and synthetic wave fronts radiated from the dipole antennas 82, 83 shown in FIG. 8A in the plane 80. Since the positions of two wave sources that are the vehicular antenna 27 and the dipole antennas 82, 83 are shifted from each other in the horizontal direction, phases of the wave fronts are also shifted with each other, so that the wave fronts are reduced with each other in a direction 85 in the plane 80 (in a portion that is surrounded by a ellipse). As a result, a biased directivity exists in the synthetic wave fronts radiated from the vehicular antenna 27 and the dipole antennas 82, 83.

Figure 10:
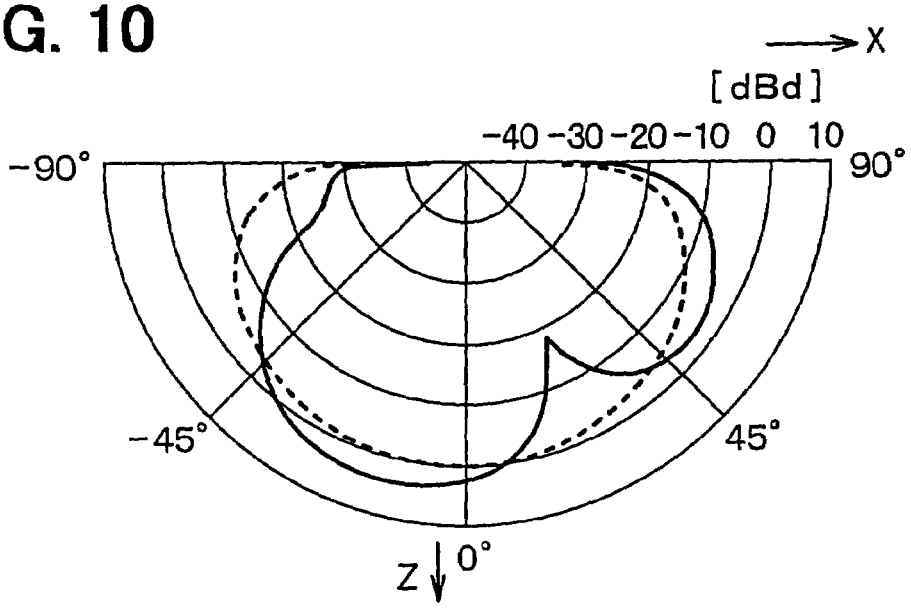
FIG. 10 shows radiation patterns of a radio wave from the vehicular antenna only and a synthetic wave according to the comparative example.

In such a situation, FIG. 10 shows a radiation pattern of the synthetic wave radiated from the vehicular antenna 27 and the dipole antennas 82, 83 on the plane 80 by a bold line in every direction. A direction indicated by an angle of 0 degree is the front direction of the monitor 2. A dashed line shows radiation pattern of the radio wave radiated from only the vehicular antenna 27. As shown in FIG. 10, the gain of the synthetic wave is reduced in the front direction of the monitor 2, especially around 30 degrees, in comparison with the gain of the vehicular antenna 27 only. Therefore, the gain of the radio wave radiated from the vehicular antenna 27 and the circuit board 23 is reduced in the front direction of the monitor 2 due to an interference of the radio waves radiated from the dipole antennas 82, 83. This is the reason that the gain of the radio wave radiated from the vehicular antenna 27 and the circuit board 23 is reduced in the front direction due to the secondary radiation from the circuit board 23. In fact, an actual measurement of the radiation pattern is not the same as FIG. 10 because plurality of pairs of the dipole antennas exists in the inner edge 36 of the circuit board 23. However, the radiation pattern is qualitatively similar to FIG. 10 as shown in FIG. 21.

Figure 11A:
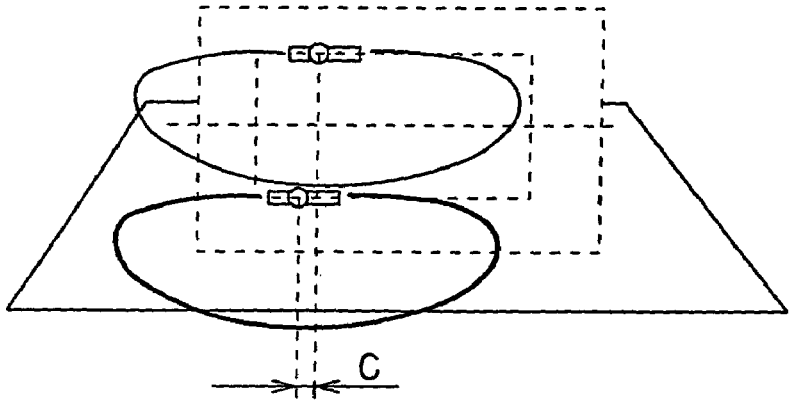
FIG. 11A is a schematic view showing radiations of radio waves radiated from a pair of in-phase dipole antennas formed on the circuit board according to the embodiment of the present invention.
Figure 11B:
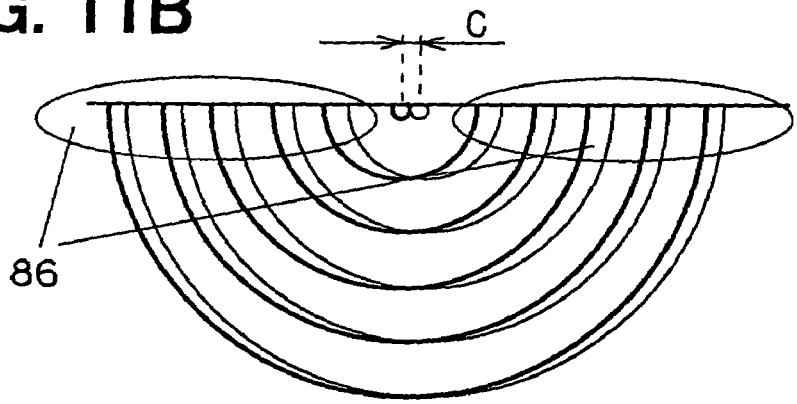
FIG. 11B shows wave fronts radiated from the pair of the in-phase dipole antennas according to the embodiment.

Next, the radiation of the embodiment of the present invention will be explained. FIG. 11A shows the radiation patterns of the radio waves from the pair of the positions through which in-phase high frequency electrical currents pass shown in FIG. 7 in the plane 80 in the same manner as FIG. 8. FIG. 11B shows wave fronts radiated from the dipole antennas 82, 83. An interval of the wave fronts is the same as the wavelength λ of the radio wave. A distance C between the dipole antennas 82, 83 in the horizontal direction is λ/2. Therefore, as shown in FIG. 11B, each phase of the wave fronts radiated by each dipole antenna 82, 83 is opposite to each other in portions surrounded by ellipses, so that each radio wave is canceled by each other. The radio waves are weakened by a phase shift in most portion other than the portions surrounded by the ellipses. The weakness of the radio wave radiated from the dipole antennas 82, 83 due to the phase shift of the wave fronts are increased as the distance C between the dipole antennas 82, 83 is increased from zero in the horizontal direction. The weakness becomes maximum when the distance C corresponds to λ/2.

The radio waves from the dipole antennas 82, 83 are weakened, so that the weakness of the gain of the radio wave radiated from the vehicular antenna 27 and the dipole antennas 82, 83 as shown in FIGS. 9, 10 due to the interference of the radio waves is reduced.

Figure 12A:
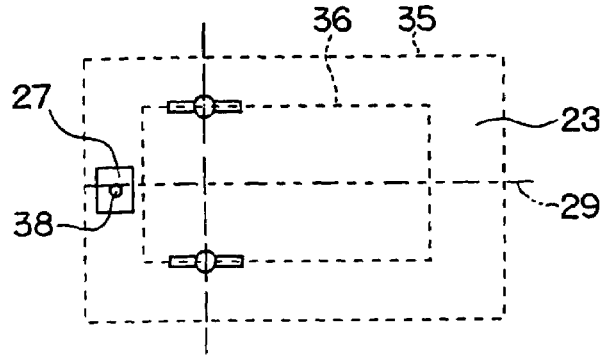
FIGS. 12A through 12D show relationships between positions of the dipole antennas and positions of an electrical contact for connecting the vehicular antenna to the circuit board.
Figure 12B:
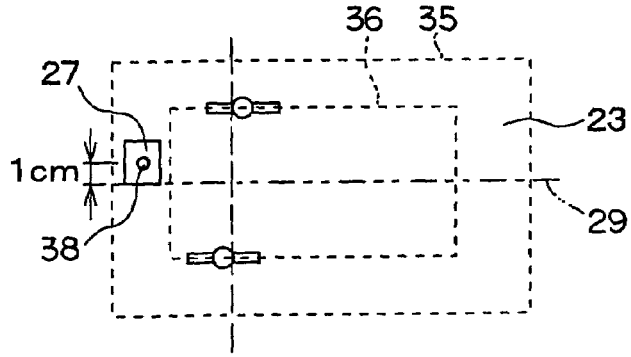
Figure 12C:
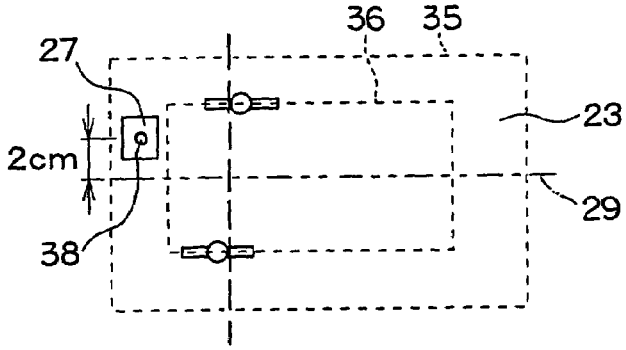
Figure 12D:
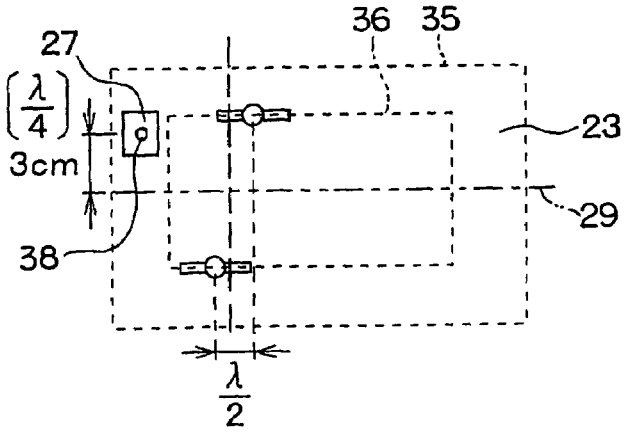

FIGS. 12A to 12D show relationships between first distance and second distance. The first distance is the distance from the centerline 29 to the electrical contact 38 of the vehicular antenna 27 and the circuit board 23. The second distance is the distance between the dipole antennas formed in the inner edge 36 of the circuit board 23. The relationships shown in FIGS. 12A to 12D are simulated by the moment method. FIG. 12A shows the relationship when the electrical contact 38, which is connected to the vehicular antenna 27, is on the centerline 29. FIG. 12B shows the relationship when the electrical contact 38 is 1 cm away from the centerline 29 in the upward direction. FIG. 12C shows the relationship when the electrical contact 38 is 2 cm away from the centerline 29 in the upward direction. FIG. 12D shows the relationship when the electrical contact 38 is 3 cm ($\lambda/4$) away from the centerline 29 in the upward direction. This shows that the second distance between the pair of the in-phase dipole antennas consecutively varies from zero to $\lambda/2$ as the first distance from the centerline 29 to the electrical contact 38 consecutively increases from zero to $\lambda/4$.

Figure 13:
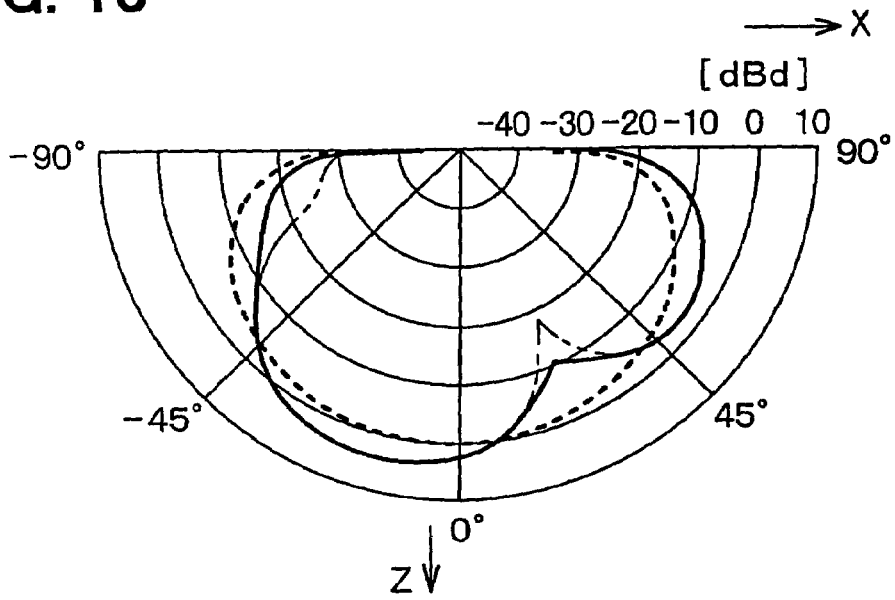
FIG. 13 shows radiation patterns of the radio wave according to the embodiment and the comparative example.

FIG. 13 shows radiation patterns of the radio waves in each situation. In FIG. 13, a dotted line shows the radiation pattern of the radio wave radiated from the vehicular antenna 27 only. A two-dot chain line shows the radiation pattern of the synthetic wave radiated from the vehicular antenna 27 and the dipole antennas 83, 84 under the condition of FIG. 12A. A solid line shows the radiation pattern of the synthetic wave radiated from the vehicular antenna 27 and the dipole antennas 83, 84 under the condition of FIG. 12D. The gain in the front direction under the condition of FIG. 12D is inferior to the gain under the condition of the vehicular antenna 27 only. However, it is prevented from reducing the gain under the condition of FIG. 12D in comparison with the condition of FIG. 12A.

The embodiment of the present invention has an effect that the reduction of the gain of the radio wave in the front direction is prevented when the vehicular antenna 27 is placed at the predetermined position some distance away from the centerline 29. The effect is obtained not only when the distance from the centerline 29 is exactly $\lambda/4$, but also when the distance is within ±1 cm away from $\lambda/4$. When the distance is within ±1 cm away from $\lambda/4$, at least 70% of the maximum effect is obtained according to a numerical calculation result by the inventor. The length 1 cm corresponds to one-tenth of the wavelength $\lambda$.

Figure 14:
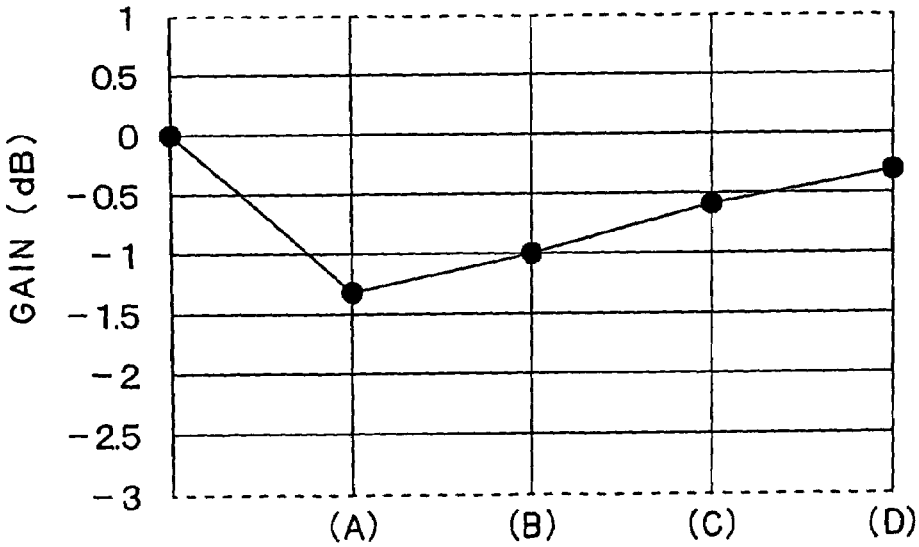
FIG. 14 is a graph showing average gains of radio waves.

That is, the reduction of the gain is prevented in comparison with the situation that the electrical contact 38 is just on the centerline 29, not only when the distance between the position of the electrical contact 38 and the centerline 29 is just $\lambda/4$, but also when the electrical contact 38 is placed at the position some distance away from the centerline 29. FIG. 14 is a graph showing average gains of the radio waves between −90 degree and +90 degree by dB unit under conditions of the vehicular antenna 27 only, and FIGS. 12A to 12D. The vertical axis indicates the condition of the vehicular antenna 27 only. Labels (A) to (D) correspond to the condition of FIGS. 12A to 12D, respectively. That is, the horizontal axis corresponds to the distance from the centerline 29 to the electrical contacts.

As shown in FIG. 14, the gain is the least in the condition of a label (A), that is, when the electrical contact 38 is placed on the centerline 29. The reduction of the gain is prevented when the electrical contact 38 is away from the centerline as shown by labels (B) to (D).

In addition, an effect similar to the above embodiment is obtained even when the distance is approximately odd-number times of $\lambda/4$, not only when the distance from the centerline 29 to the electrical contact 38 is approximately $\lambda/4$. This will be explained by FIGS. 15A to 15D. FIGS. 15A to 15D show arrangements of dipole antennas 61 to 65 and 71 to 75 formed in the inner edge of the circuit board 23 when the distance between the electrical contact 38 and the centerline 29 is zero (0), $\lambda/4$, $2\lambda/4$, and $3\lambda/4$, respectively. The arrangements are simulated with the moment method. The dipole antennas with odd numerals are in the in-phase relationship with each other. The other dipole antennas with even numerals are in the reverse-phase relationship in comparison with the in-phase dipole antennas.

Figure 15B:
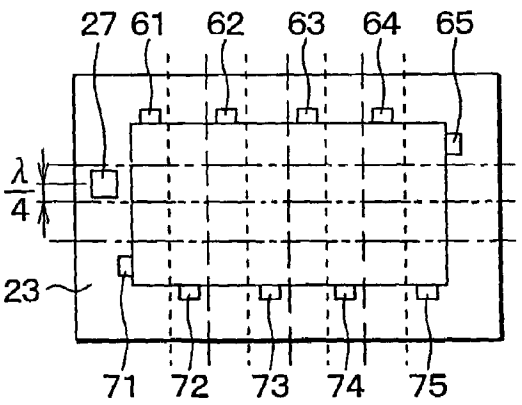
FIGS. 15A through 15D show relationships between positions of the dipole antennas and positions of the electrical contact.
Figure 15D:
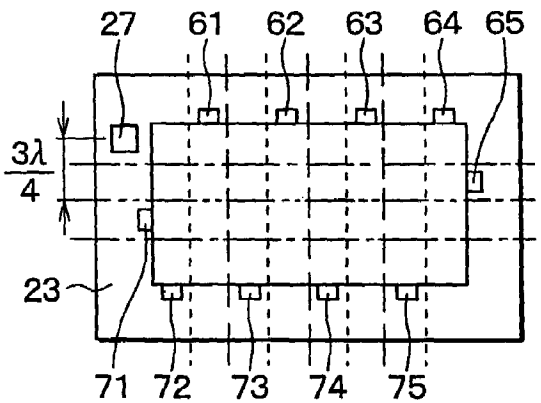
Figure 15A:
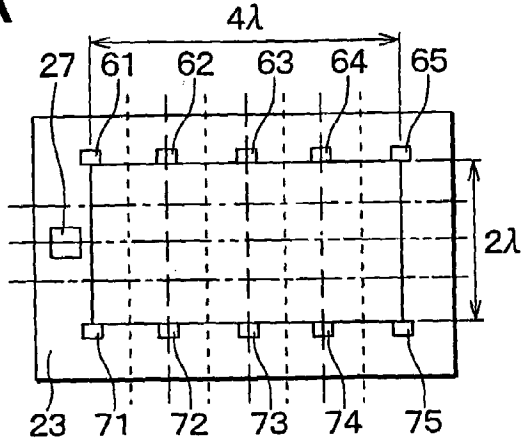
Figure 15C:
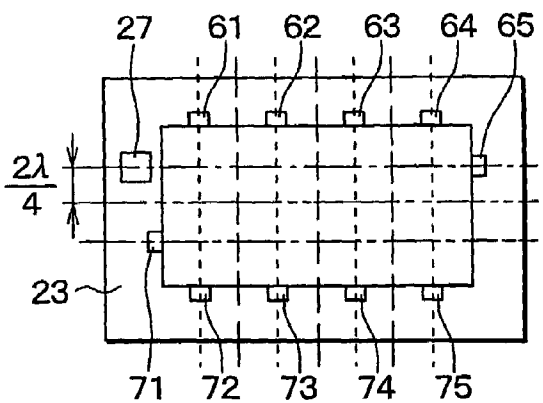

The dipole antennas 61 to 65, and 71 to 75 move clockwise along the inner edge 36 as the distance between the electrical contact 38 and the centerline 29 becomes long as shown in FIG. 15A to 15D. As shown in FIGS. 15B and 15D, shift lengths between the pair of the in-phase dipole antennas or the pair of the reverse-phase dipole antennas in the horizontal direction in FIG. 15D is the same as in FIG. 15B. For example, in FIG. 15B, the radio waves from the dipole antennas 63, 73 are weakened by each other because of the positions. In FIG. 15D, the radio waves from the dipole antennas 63, 75 are also weakened by each other because of the positions. Accordingly, the reduction of the gain of the radio wave in the front direction is reduced to the maximum even when the distance between the electrical contact 38 and the centerline 29 is $3\lambda/4$. Furthermore, the relationship of the positions of the pair of the in-phase dipole antennas or the pair of the reverse-phase dipole antennas is the same as FIGS. 15B, 15D at every $\lambda/2$ if the distance becomes longer than $3\lambda/4$. Accordingly, the effect similar to the above embodiment is obtained even when the distance between the electrical contact 38 and the centerline 29 is approximately odd-number times of $\lambda/4$.

That is, in FIG. 14, when the distance becomes longer than the condition of the label (D), the average gain is reduced after the condition of the label (D) as a peak. Then, when the distance is even-number times $\lambda/4$, the gain becomes minimum. Then, when the distance is odd-number times $\lambda/4$, the gain becomes maximum again. However, the effect is available only when the electrical contact 38 is placed within the circuit board 23.

Figure 16:
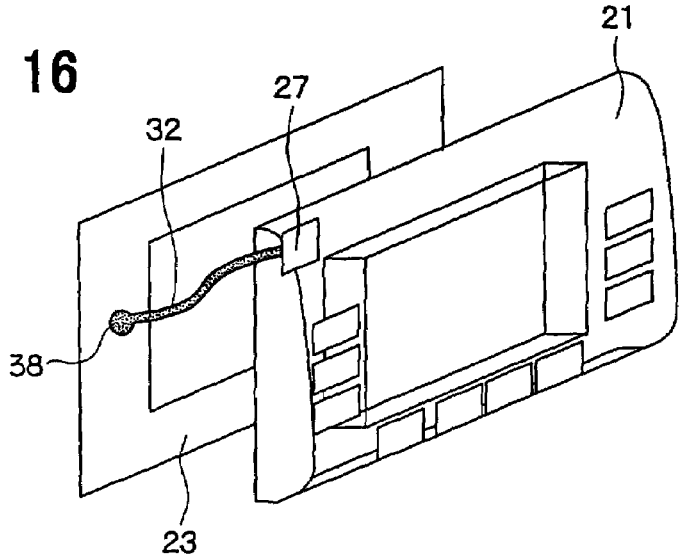
FIG. 16 is a perspective view showing a connection of the vehicular antenna and the electrical contact according to another embodiment of the present invention.

The present invention should not be limited to the embodiments discussed above and shown in the figures, but may be implemented in various ways without departing from the spirit of the invention. For example, in the electrical monitor 2', the vehicular antenna 27 is directly connected to the electrical contact 38 on the circuit board 23 for connecting the vehicular antenna 27. However, the vehicular antenna 27 may be connected to the circuit board 23 via a coaxial cable 32 as shown in FIG. 16. That is, the vehicular antenna 27 may be indirectly connected to the circuit board 23 on the electrical contact 38 of the circuit board 23.

In the embodiment, the centerline 29 is used as the axisymmetrical line that is a starting point of the distance to the electrical contact 38 on the circuit board 23. However, another axisymmetrical line of a vertical direction, which divides the surface of the circuit board 23 into a right area and a left area, can be used as the axisymmetrical line.

In the embodiment, the wireless communication circuit 26 and the control circuit 24 are connected with each other by the wire. However, it is not necessary for the wireless communication circuit 26 to be connected to the control circuit 24. The wireless communication circuit 26 may be connected only to another information device inside the vehicle. Generally, the wireless communication circuit 26 and the vehicular antenna 27 need only to be used for in-vehicle wireless communication, and are accordingly mounted on the electrical monitor 2'. It is not necessary for the wireless communication circuit 26 to communicate signals with the control circuit 24.

Although the circuit board 23 and the inner edge of the circuit board 23 have the rectangular shape, the corner of the circuit board 23 and the inner edge 26 may be round.

What is claimed is:

1. A method for installing an antenna that uses a conductor as a ground, wherein the conductor has a frame shape and includes an inner edge having a rectangular shape, the method comprising steps of:

providing an electrical contact on the conductor and away from an axisymmetrical line defined with respect to the inner edge, the electrical contact being used for connecting the antenna; and connecting the antenna to the electrical contact;

wherein the electrical contact is disposed at a predetermined distance from the axisymmetrical line, and the predetermined distance is determined by one fourth of a wavelength of a radio wave associated with the antenna multiplied by an odd integer.

2. A method for installing an antenna that uses a conductor as a ground, wherein the conductor has a frame shape and includes an inner edge having a rectangular shape, the method comprising steps of:

providing an electrical contact on the conductor and away from an axisymmetrical line defined with respect to the inner edge, the electrical contact being used for connecting the antenna; and connecting the antenna to the electrical contact;

wherein the electrical contact is disposed within a predetermined distance from a predetermined position, the predetermined position is determined by an odd integer multiplied by one fourth of a wavelength of a radio wave associated with the antenna away from the axisymmetrical line, and the predetermined distance is determined by one tenth of the wavelength.

3. An antenna installation structure comprising:

a conductor that has a frame shape having an inner edge; and an antenna that uses the conductor as a ground, wherein the inner edge has a rectangular shape, and the conductor has an electrical contact for connecting the antenna, the electrical contact is placed away from an axisymmetrical line defined with respect to the inner edge;

wherein the electrical contact is disposed at a predetermined distance from the axisymmetrical line, and the predetermined distance is determined by one fourth of a wavelength of a radio wave associated with the antenna multiplied by an odd integer.

4. An antenna installation structure comprising:

a conductor that has a frame shape having an inner edge; and an antenna that uses the conductor as a ground, wherein the inner edge has a rectangular shape, and the conductor has an electrical contact for connecting the antenna, the electrical contact is placed away from an axisymmetrical line defined with respect to the inner edge;

wherein the electrical contact is disposed within a predetermined distance from a predetermined position, the predetermined position is determined by an odd integer multiplied by one fourth of a wavelength of a radio wave associated with the antenna away from the axisymmetrical line, and the predetermined distance is determined by one tenth of the wavelength.

5. A monitor used in a vehicle comprising:

a display for displaying a image, the display having a rectangular shape;

a panel that surrounds the display so that the image is visible;

a circuit board that has a rectangular frame shape having an inner edge so that the display passes through the circuit board; and an antenna that is used for wireless communication within the vehicle, wherein the panel has an operational button, the circuit board has a first substrate having a circuit for detecting an input from the operational button and a second substrate formed of a conductive plate, the antenna uses the conductive plate as a ground, and the circuit board has an electrical contact of the conductive plate for connecting the antenna, the electrical contact is disposed away from an axisymmetrical line defined with respect to the inner edge.

6. The monitor according to claim 5, wherein the electrical contact is disposed at a predetermined distance from the axisymmetrical line, and the predetermined distance is determined by one fourth of a wavelength of a radio wave associated with the antenna multiplied by an odd integer.

7. The monitor according to claim 5, wherein the electrical contact is disposed within a predetermined distance from a predetermined position, the predetermined position is determined by an odd integer multiplied by one fourth of a wavelength of a radio wave associated with the antenna away from the axisymmetrical line, and the predetermined distance is determined by one tenth of the wavelength.

* * * * *